US008331821B2

(12) United States Patent
Nakayama

(10) Patent No.: US 8,331,821 B2
(45) Date of Patent: Dec. 11, 2012

(54) FIXING DEVICE AND IMAGE FORMING APPARATUS HAVING THE SAME

(75) Inventor: Atsuyoshi Nakayama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 397 days.

(21) Appl. No.: 12/652,119

(22) Filed: Jan. 5, 2010

(65) Prior Publication Data

US 2010/0172669 A1 Jul. 8, 2010

(30) Foreign Application Priority Data

Jan. 7, 2009 (JP) ..... 2009-002070

(51) Int. Cl.
*G03G 15/20* (2006.01)

(52) U.S. Cl. ..... 399/70; 399/69; 399/328

(58) Field of Classification Search ..... 399/69, 399/70, 328, 330, 331
See application file for complete search history.

(56) References Cited

U.S. PATENT DOCUMENTS 7,194,233 B2 * 3/2007 Wu et al. ..... 399/328
2007/0212093 A1 * 9/2007 Maeda et al. ..... 399/69
2007/0212094 A1 * 9/2007 Asakura et al. ..... 399/69
2007/0217807 A1 * 9/2007 Maeda et al. ..... 399/69
2007/0217838 A1 9/2007 Yamana et al.
2007/0248389 A1 * 10/2007 Asakura et al. ..... 399/328
2007/0264059 A1 * 11/2007 Maeda et al. ..... 399/328 X
2007/0297826 A1 * 12/2007 Tateishi et al. ..... 399/69
2008/0003009 A1 1/2008 Minakuchi et al.

FOREIGN PATENT DOCUMENTS

JP 2005-241785 9/2005
JP 2007-248724 9/2007
JP 2008-9151 A 1/2008

* cited by examiner

*Primary Examiner* — Sandra Brase
(74) *Attorney, Agent, or Firm* — Renner, Otto, Boisselle & Sklar, LLP

(57) ABSTRACT

A fixing device which can prevent deterioration and breakage of each member, and an image forming apparatus having the fixing device are provided. A separation/contact mechanism carries out separation/contact operation of an external heating section with respect to a fixing roller by turning the whole external heating section using a central axis of a rotation supporting roller out of a pair of rotation supporting rollers, as a rotation axis. This constitution can decrease impact force generated at the time of pressure-contact, and can prevent deterioration and breakage of the external heating belt and the fixing roller. Furthermore, when a heater lamp is provided in only the rotation supporting roller, positional deviation and damage of the heater lamp can be prevented.

4 Claims, 8 Drawing Sheets

FIXING DEVICE AND IMAGE FORMING APPARATUS HAVING THE SAME

CROSS-REFERENCE TO RELATED APPLICATION

This application claims priority to Japanese Patent Application No. 2009-002070, which was filed on Jan. 7, 2009, the contents of which are incorporated herein by reference in their entirety.

BACKGROUND OF THE INVENTION

1. Field of the Invention

The present invention relates to a fixing device which fixes an unfixed toner image to a recording material by a hot pressing method, and an image forming apparatus having the fixing device.

2. Description of the Related Art

A fixing device of a heating roller fixing system is generally used in an image forming apparatus of an electrophotographic system, such as copiers, printers and multi-function peripherals. The fixing device is constituted of a fixing roller and a pressure roller, which are in pressure-contact with each other, and surfaces of both the fixing roller and the pressure roller, or surface of either of those rollers are heated to a predetermined temperature (fixing temperature) with a heat source (for example, halogen lamp) provided in the rollers.

A recording paper having an unfixed toner image transferred thereto is passed through a pressure-contact portion (fixing nip portion) between two rollers, thereby a toner image is fixed to the surface of a recording paper by heat and pressure.

An elastic roller provided with an elastic layer comprising a silicone rubber or the like is generally used as a fixing roller in a fixing device used in a color printer.

When the fixing roller is provided with an elastic layer, the surface of the fixing roller elastically deforms in response to irregularity of an unfixed toner image on a recording paper, and comes into contact with a recording paper so as to cover a face having a toner image formed thereon. This permits to well carry out heat fixation to a color printing in which an amount of a toner constituting an unfixed toner image is large as compared with a monochrome printing.

Furthermore, a strain release effect of an elastic layer in a fixing nip portion can improve releasability to a toner even in a color printing which easily induces offset as compared with a monochrome printing.

Moreover, the fixing nip portion has an inverted nip shape, that is, a state where a portion of a fixing roller coming into contact with a pressure roller gets slightly dented. As a result, release performance of a recording paper is improved, a recording paper is easily released from the surface of a fixing roller without using a release member such as release nail, and an image defect caused by a release member can be prevented.

The elastic layer has the above-described good fixing characteristics, but on the other hand, has low thermal conductivity. Therefore, in the case where a heat source is provided in a fixing roller equipped with an elastic layer, heat transfer efficiency to the surface of a fixing roller is decreased. As a result, a warm-up period is prolonged. Furthermore, in the case where conveying speed of paper is increased for high-speed printing, there is a problem that surface temperature of a fixing roller does not follow the speed.

An external heat fixing method in which an external heating section is brought into contact with the surface of a fixing roller and the fixing roller is heated externally (surface side) is known as means for solving the problem arising from low thermal conductivity.

A roller method of coming into contact with a heating roller having a heat source therein with the surface of a fixing roller; a belt method of heating an endless belt member and bringing the belt member into contact with the surface of a fixing roller; and the like are proposed as the external heating section. The belt method can ensure a wide heating nip width with smaller heat capacity as compared with the roller method. Therefore, amount of heat that can be supplied to the surface of a fixing roller is large, and follow-up properties of the surface temperature of a fixing roller in high-speed printing are excellent.

On the other hand, the belt method has the following problem. When rotation of a fixing roller is stopped after completion of fixing operations, a heating member which heats the belt member comes into contact with the fixing roller with the belt member interposed therebetween. As a result, the contact portion is locally heated, thereby accelerating deterioration of an elastic layer. This local overheating is hereinafter referred to as "overshoot".

In other words, in the belt method, heat supply ability to a fixing roller is high, and a plurality of members such as the belt member and belt supporting rollers are interposed between a heat source and the surface of a fixing roller. This increases a temperature gradient between the heat source and the surface of the belt member. As a result, when rotation of the fixing roller is stopped and heat transfer to the fixing roller is instantaneously blocked, temperature of the belt supporting rollers and the belt member is increased due to the temperature gradient and a fixing roller portion with which a belt winding roller comes into contact through the belt member is locally overheated. In particular, because heat capacities of a belt winding roller, an endless belt and the like are small, the overshoot due to temperature gradient is markedly developed.

Further, generation of the overshoot induces the problem that temperature irregularity is generated on the surface of a fixing roller, resulting in occurrence of gloss irregularity on an image subsequently fixation-treated.

Furthermore, in a system requiring a change of surface temperature of the fixing roller according to image data to be printed, in the case of decreasing surface temperature of a fixing roller during fixing operations, a heat source disposed inside the fixing roller and a heat source disposed inside the belt supporting roller are turned off, and the fixing roller is rotated in this state, thereby decreasing temperature on the surface of the fixing roller.

However, temperature of the belt supporting roller is set to a temperature higher than a fixation temperature. This induces the problem that much time is required to decrease the surface temperature of the fixing roller.

These problems arise from the state where an external heating section is always in contact with a fixing roller. Therefore, when the external heating section is constituted such that the external heating section can be separated from and brought into contact with the fixing roller, those problems can be solved.

In the case where separation/contact operation of the fixing roller is allowed, the heating member has a temperature higher than the temperature on the surface of the fixing roller even when heating is stopped. Therefore, there is a problem that when the belt member is completely separated from the fixing roller, heat transferred to a portion which comes into contact with the heating member concentrates in the vicinity of the contact portion in the belt member, and this accelerates deterioration of the belt member. In the constitution that even the belt member is completely separated, movement distance necessary for separation is large. This induces problems that a wide space is required for the movement of separation and contact, and a space-saving constitution is not achieved.

Japanese Unexamined Patent Publication JP-A 2007-248724 discloses a fixing device, characterized in that a belt member and a fixing member come into contact with each other in a state where the heating member is separated from the fixing member, and the belt member rotates by following rotation of the fixing member. This fixing device is hard to deteriorate the belt member and can achieve a space-saving constitution, an electric power saving and a quick separation/contact operation.

However, in the case where the heating member in a separated state comes into contact with the fixing member by a quick separation/contact operation, impact force is transferred to an endless belt, a fixing roller and a heater lamp mounted in a heating member with a shock by the contact, resulting in a breakage of an endless belt or a fixing roller, and a positional deviation or a damage of a heater lamp.

When the heating member is moved, in the case where the heating member is not in pressure-contact with a fixing member under an appropriate pressure, a driven rotation of the belt member is not smoothly carried out, causing a poor rotation. This induces a lack in heat supply to the fixing member and a deterioration of the belt member.

SUMMARY OF THE INVENTION

An object of the invention is to provide a fixing device capable of preventing deterioration and breakage of each member, and an image forming apparatus having the fixing device.

The invention provides a fixing device, comprising:

a fixing member which is rotatably provided around an axis thereof, heats a recording material bearing an unfixed toner image, and melts a toner constituting the unfixed toner image;

a pressure member which is rotatably provided around an axis thereof, comes into pressure-contact with the fixing member to form a pressure-contact portion between the pressure member and the fixing member, pressurizing the conveyed recording material bearing the unfixed toner image at the pressure-contact portion, and fixing the unfixed toner image to the recording material in cooperation with the fixing member;

an external heating section including a plurality of supporting rollers, an endless external heating belt rotatably supported around the plurality of supporting rollers with tension so as to come in contact with an outer periphery of the fixing member, and a heating member for heating the external heating belt, thereby heating the outer periphery; and a separation/contact section which carries out separation/contact operation of the external heating section with respect to the fixing member by rotating the external heating section using a central axis of one supporting roller out of the plurality of supporting rollers, as a rotation axis.

According to the invention, in the case where the external heating section comes into pressure-contact with the fixing member by the separation/contact section, the external heating section is rotated using a central axis of one supporting roller out of the plurality of supporting rollers, as a rotation axis, thereby bringing the external heating section and the fixing member into pressure-contact with each other.

This constitution can decrease impact force generated at the time of pressure-contact as compared with the conventional constitution in which separation/contact operation of the whole external heating section is carried out by moving the same, and can prevent a deterioration and a breakage of the external heating belt and the fixing member.

Furthermore, the constitution can decrease the movement space of the external heating section required at the time of separation/pressure-contact operation, and therefore can realize downsizing of the apparatus.

Moreover, in the invention, it is preferable that out of the plurality of supporting rollers, only the supporting roller having a central axis as the rotation axis has the heating member therein.

According to the invention, the supporting roller having a central axis as the rotation axis is unmoved during the separation/contact operation. Therefore, impact force generated at the time of pressure-contact to the supporting roller is minimized. When the heating member is provided in only the inside of the supporting roller of interest, impact force to the heating member can be decreased, and a positional deviation and a damage can be prevented.

Further, in the invention, it is preferable that the supporting roller having a central axis becoming the rotation axis comes into pressure-contact with the fixing member with the external heating belt interposed therebetween in both of a separated state where the external heating section is separated from the fixing member and a pressure-contact state where the external heating section comes into pressure-contact with the fixing member.

According to the invention, the supporting roller having a central axis becoming the rotation axis is unmoved during the separation/contact operation and comes into pressure-contact with the fixing member with the external heating belt interposed therebetween in both of a separated state and a pressure-contact state.

This constitution can prevent poor driven rotation of the external heating belt to the fixing member, and can homogenize temperature distribution on the surface of the fixing member.

Further, in the invention, it is preferable that the separation/contact section carries out separation/contact operation of the external heating section with respect to the fixing member, based on the surface temperature of the fixing member.

According to the invention, the separation/contact can be carried out according to the surface temperature of the fixing member. Therefore, time required to rise the surface temperature of the fixing member to a preset temperature can be shortened and a deterioration of the fixing member due to overheating can be prevented.

Further, the invention provides an image forming apparatus having the fixing device, comprising a control part which controls operation of the separation/contact section, wherein the control part controls the separation/contact section such that when power source of the image forming apparatus is turned off and when transferring to a sleep mode in which current is applied to only the control part, the external heating section is separated from the fixing member, and when powder source of the image forming apparatus is turned on and when returning from the sleep mode, the external heating section comes into pressure-contact with the fixing member.

According to the invention, the external heating section comes into pressure-contact with the fixing member only in the case where users desire to use the image forming apparatus. Therefore, overshoot due to local heating of the fixing member by the external heating belt can be avoided, and thermal deterioration of the fixing member can be prevented.

In the case where temperature is decreased in the state where the external heating belt comes into pressure-contact with the fixing member, poor driven rotation is generated by hardening of the external heating belt. However, in the case where users do not use the image forming apparatus, the external heating section is separated from the fixing member. As a result, the external heating belt can be separated before decreasing the temperature of the fixing member, and poor driven rotation of the external heating belt can be prevented.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
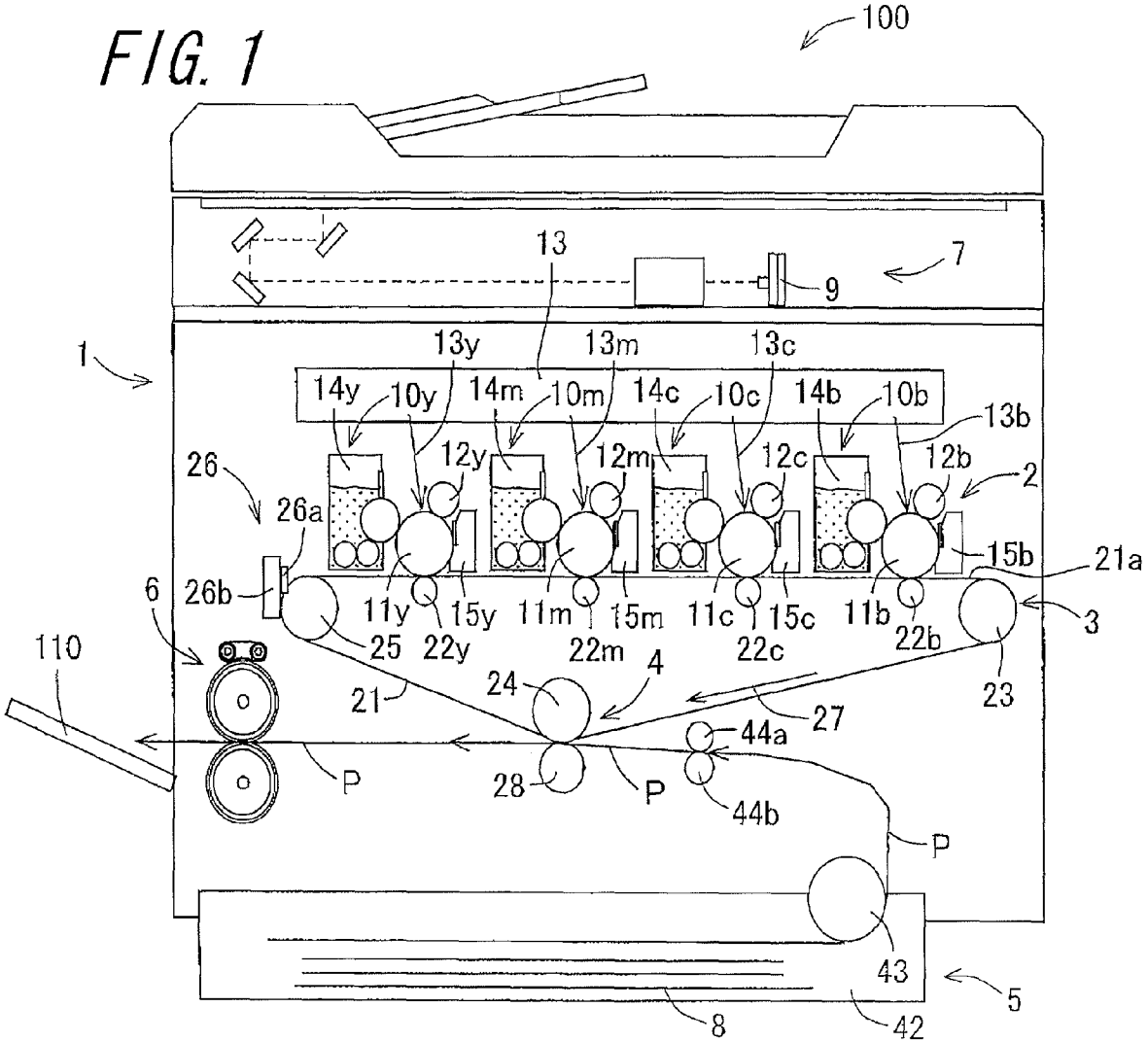
FIG. 1 is a cross sectional view schematically showing a configuration of a copier according to one embodiment of the invention.

Now referring to the drawings, preferred embodiments of the invention are described below.

Figure 2:
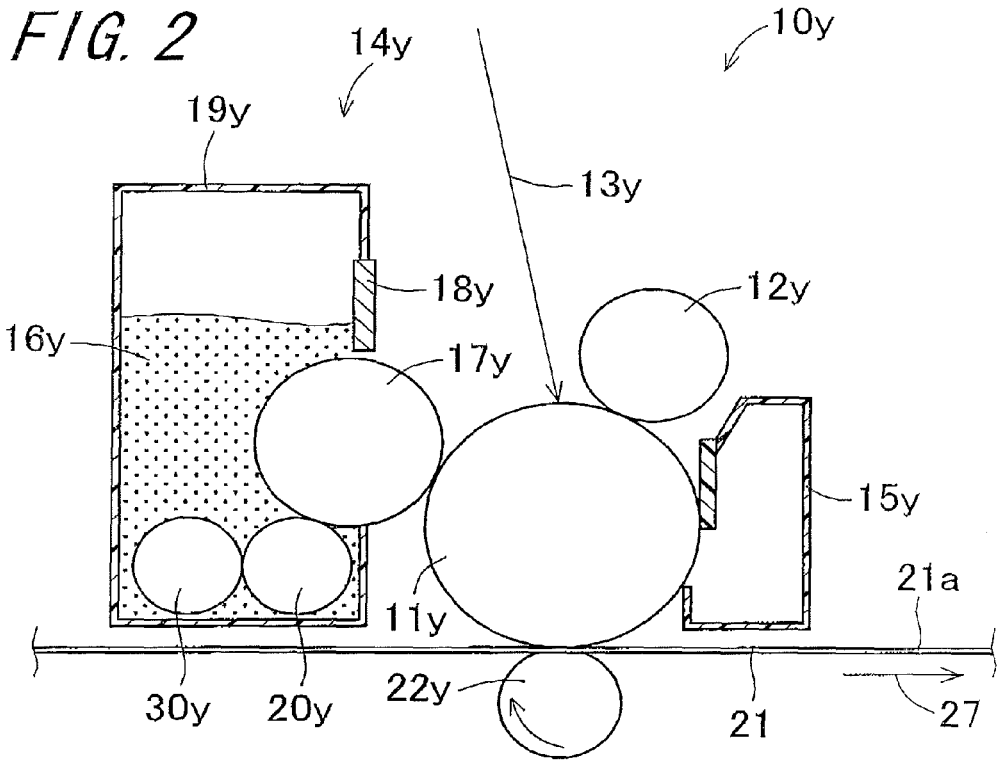
FIG. 2 is an enlarged sectional view of a configuration of a main portion of an image forming apparatus shown in FIG. 1.

FIG. 1 is a cross sectional view schematically showing a configuration of a copier 100 according to one embodiment of the invention. FIG. 2 is an enlarged sectional view of a configuration of a main portion of an image forming apparatus 1 shown in FIG. 1.

The copier 100 includes the image forming apparatus 1 and a scanner section 7. The image forming apparatus 1 is a tandem-type electrophotographic image forming apparatus in which toner images of four colors yellow, magenta, cyan, and black are sequentially transferred and overlaid on top of one another to form a multicolor toner image and the multicolor toner image is fixed to a recording material to form an image. The image forming apparatus 1 includes a toner image forming section 2, an intermediate transfer section 3, a secondary transfer section 4, a recording material feeding section 5, and a fixing device 6.

The toner image forming section 2 includes image forming units 10*y*, 10*m*, 10*c*, and 10*b*. The image forming units 10*y*, 10*m*, 10*c*, and 10*b* are aligned in a row from an upstream side along a rotational direction (sub-scanning direction) of a later-described intermediate transfer belt 21, i.e., a direction of an arrow 27. The image forming units 10*y*, 10*m*, 10*c*, and 10*b* form toner images of the respective colors as follows. In the image forming units 10*y*, 10*m*, 10*c*, and 10*b*, electrostatic latent images are formed which correspond to image information of the respective colors input as digital signals, and toners of corresponding colors are then supplied to the electrostatic latent images to thereby develop the images. The image forming unit 10*y* forms a toner image corresponding to yellow image information. The image forming unit 10*m* forms a toner image corresponding to magenta image information. The image forming unit 10*c* forms a toner image corresponding to cyan image information. The image forming unit 10*b* forms a toner image corresponding to black image information. The image forming unit 10*y* includes a photoreceptor drum 11*y*, a charging roller 12*y*, a light scanning unit 13, a developing device 14*y*, and a drum cleaner 15*y*.

The photoreceptor drum 11*y* is a roller-shaped member that is rotatably supported about an axial line thereof by a driving section (not shown) and that has a photosensitive layer on which surface the electrostatic latent image and thus the toner image are formed. The usable photoreceptor drum 11*y* may be composed of a conductive substrate (not shown) and a photoreceptor drum (not shown) formed on a surface of the conductive substrate. An applicable shape of the conductive substrate may be cylindrical, columnar, sheet-like, or the like, among which cylindrical is preferable. Examples of the photosensitive layer include an organic photosensitive layer and an inorganic photosensitive layer. The organic photosensitive layer may be a laminate composed of a charge generating layer which is a resin layer containing a charge generating substance, and a charge transporting layer which is a resin layer containing a charge transporting substance, or may be a resin layer which contains a charge generating substance and a charge transporting substance in a single resin layer. The inorganic photosensitive layer may be a layer which contains substances such as one or two or more zinc oxide, selenium, amorphous silicon, and the like. An undercoat layer may be interposed between the conductive substrate and the photosensitive layer, and a surface of the photosensitive layer may be provided with a surface layer (a protective layer) for protecting the photosensitive layer mainly. In the present embodiment, a 30 mm-diameter photoreceptor drum is used which contains an aluminum tube (a conductive substrate) connected to ground potential (GND) and a 20 μm-thick organic photosensitive layer formed on a surface of the aluminum tube. Further, in the embodiment, the photoreceptor drum fly rotates in a clockwise direction at a peripheral velocity of 355 mm/s.

The charging roller 12*y* is a roller-shaped member which is rotatably supported about an axial line thereof by a driving section (not shown) and which charges the surface of the photoreceptor drum 11*y* with predetermined polarity and potential. The charging roller 12*y* is connected to a power source (not shown). Application of voltage by the power source to the charging roller 12*y* causes discharge of electricity to thereby charge the surface of the photoreceptor drum 11*y*. In the embodiment, voltage of −1200 V is applied to the charging roller 12*y*, and the surface of the photoreceptor drum 11*y* is thereby charged to −600 V. The charging roller 12*y* can be replaced by a brush-type charging device, a charger-type charging device, and a corona charging device such as a scorotron charger. The light scanning unit 13 irradiates the charged surface of the photoreceptor drum 11*y* with laser light 13*y* corresponding to yellow image information to thereby form on the surface of the photoreceptor drum 11*y* an electrostatic latent image corresponding to the yellow image information. For the light scanning unit 13, a semiconductor laser or the like component can be used. In the embodiment, an electrostatic latent image having an exposure potential of −70 V is formed on the surface of the photoreceptor drum 11*y* which surface has been charged to −600 V.

The developing device 14*y* includes a developing roller 17*y*, a developing blade 18*y*, a developer tank 19*y*, and stirring rollers 20*y* and 30*y*. Yellow developer 16*y* is borne on a surface of the developing roller 17*y* and supplied therefrom to the electrostatic latent image on the surface of the photoreceptor drum 11*y* at an area (named as "a developing nip portion") where the developing roller 17*y* and the photoreceptor drum 11*y* come close to each other. The developing roller 17*y* is a roller-shaped member that is rotatably supported about an axial line thereof by the developer tank 19*y* and is disposed so as to have a part thereof protrude outward from an opening formed on a surface of the developer tank 19*y* which surface faces the photoreceptor drum 11*y*, to thereby come close to the surface of the photoreceptor drum 11*y*, and that internally contains a fixed magnetic pole (not shown). The developing roller 17*y* rotates in a direction opposite to a rotational direction of the photoreceptor drum 11*y*. Accordingly, at the developing nip portion, the developing roller 17*y* and the photoreceptor drum 11*y* rotate in the same direction. Further, the developing roller 17*y* is connected to a power source (not shown) which applies DC voltage (development voltage) to the developing roller 17*y*. This causes the yellow developer 16*y* on the surface of the developing roller 17*y* to be smoothly supplied to the electrostatic latent image. In the embodiment, −420 V of development voltage is applied to the developing roller 17*y*. An yellow toner layer on the surface of the developing roller 17*y* comes into contact with the photoreceptor drum 11*y* at the developing nip portion where the yellow developer 16*y* is thereby supplied to the electrostatic latent image.

The developing blade 18*y* is a platy member which is provided with one end supported by the developer tank 19*y* and the other end distanced away from the surface of the developing roller 17*y*. The developing blade 18*y* is used for homogenization (layer regulation) of the yellow toner layer borne on the surface of the developing roller 17*y*. The developer tank 19*y* is a container-shaped member which has the opening on the surface facing the photoreceptor drum 11*y* as described above and which has an internal space. The developer tank 19*y* contains the developing roller 17*y* and the stirring rollers 20*y* and 30*y* housed in the internal space, and stores the yellow developer 16*y* therein. The developer tank 19*y* is replenished with the yellow developer 16*y* which is supplied from a toner cartridge (not shown) according to a consumption situation of the yellow developer 16*y*.

In the embodiment, the developer tank 19 has been filled with magnetic carrier in advance. The magnetic carrier is mixed with a yellow toner supplied to the developer tank 19*y*, resulting in the yellow developer (a yellow two-component developer) 16*y*. A form of the developer is, however, not limited to the above form of two-component developer, and a form of one-component developer containing yellow toner only is also applicable. The stirring rollers 20*y* and 30*y* are screw-shaped members which are rotatably supported about respective axial line thereof in the internal space of the developer tank 19*y*. The stirring roller 20*y* is disposed so as to come into pressure-contact with the surface of the developing roller 17*y*. The stirring rollers 20*y* and 30*y* respectively rotate to thereby supply the yellow developer 16*y* which is supplied from the toner cartridge into the developer tank 19*y*, to a vicinity of the surface of the developing roller 17*y*.

In the developing device 14*y*, the yellow developer 16*y* which has been formed by attaching the yellow toner to the magnetic carrier in the developer tank 19*y*, is supplied by the stirring rollers 20*y* and 30*y* to the surface of the developing roller 17*y* on which a developer layer is thereby formed. A thickness of the developer layer is homogenized by the developing blade 18*y* and then, from the developer layer, the yellow developer 16*y* is selectively supplied to the electrostatic latent image on the surface of the photoreceptor drum 11*y* by using a difference in potential, resulting in a yellow toner image corresponding to the yellow image information.

The drum cleaner 15*y* removes and thus collects the yellow developer 16*y* which remains on the surface of the photoreceptor drum 11*y* after the yellow toner image has been transferred from the surface of the photoreceptor drum 11*y* to the intermediate transfer belt 21 as hereinafter described. In the image forming unit 10*y*, the light scanning unit 13 irradiates the surface of photoreceptor drum 11*y* which has been charged by the charging roller 12*y*, with laser light 13*y* which is signal light corresponding to the yellow image information, thereby forming the electrostatic latent image which is then developed with the yellow developer 16*y* supplied thereto from the developing device 14*y*, with the result that the yellow toner image is formed. The yellow toner image is transferred to the intermediate transfer belt 21 which comes into pressure-contact with the surface of the photoreceptor drum 11*y* and rotates in a direction of an arrow 27 as hereinafter described.

The yellow developer 16*y* remaining on the surface of the photoreceptor drum 11*y* is removed and thus collected by the drum cleaner 15*y*. This image (toner image) forming operation is repeatedly carried out. The image forming units 10*m*, 10*c*, and 10*b* respectively have the structures corresponding to the image forming unit 10*y* except that a magenta toner, a cyan toner, or a black toner is used instead of the yellow toner. Descriptions of the image forming units 10*m*, 10*c*, and 10*b* will be thus omitted by denoting the same reference symbols as those for the image forming unit 10*y*, which symbols will be followed respectively by "m" indicative of magenta, "c" indicative of cyan, and "b" indicative of black.

The intermediate transfer section 3 includes the intermediate transfer belt 21, intermediate transfer rollers 22*y*, 22*m*, 22*c*, and 22*b*, supporting rollers 23, 24, and 25, and a belt cleaner 26. The intermediate transfer belt 21 is an endless belt-shaped toner image bearing member which is supported around the supporting rollers 23, 24, and 25 with tension to form a loop-like travel path. The intermediate transfer belt 21 rotates in the direction of the arrow 27 at a velocity which is substantially the same as that of the photoreceptor drums 11*y*, 11*m*, 11*c*, and 11*b*. For the intermediate transfer belt 21, a 100 μm-thick polyimide film can be used, for example. A material of the intermediate transfer belt 21 is not limited to a polyimide film, and it is possible to use a film made of synthetic resin such as polycarbonate, polyamide, polyester, and polypropylene, or a film made of various rubbers. In the films made of the synthetic resin or the various rubbers, a conductive material such as furnace black, thermal black, channel black, or graphite carbon, is blended in order to adjust an electric resistance value of the intermediate transfer belt 21. A toner image bearing surface 21*a* of the intermediate transfer belt 21 comes into pressure-contact with the photoreceptor drums 11*y*, 11*m*, 11*c*, and 11*b* in the order just stated from the upstream side in the rotational direction of the intermediate transfer belt 21. Positions where the intermediate transfer belt 21 comes into pressure-contact with the photoreceptor drums 11*y*, 11*m*, 11*c*, and 11*b*, are positions where toner images of respective colors are transferred. The intermediate transfer rollers 22*y*, 22*m*, 22*c*, and 22*b* are arranged at positions which are respectively opposite to the photoreceptor drums 11*y*, 11*m*, 11*c*, and 11*b* with the intermediate transfer belt 21 interposed therebetween.

The intermediate transfer rollers 22*y*, 22*m*, 22*c*, and 22*b* are roller-shaped members which are respectively opposite to the photoreceptor drums 11*y*, 11*m*, 11*c*, and 11*b* with the intermediate transfer belt 21 interposed therebetween and come into pressure-contact with a reverse side of the toner image bearing surface 21*a* of the intermediate transfer belt 21 and which are rotatably disposed about respective axial line of the rollers by a driving section (not shown). For each of the intermediate transfer rollers 22*y*, 22*m*, 22*c*, and 22*b*, a roller-shaped member is used, for example, which is composed of a metallic shaft and a conductive layer covering a surface of the metallic shaft. The shaft is, for example, formed of a metal such as stainless steel. A diameter of the shaft is not particularly limited, and preferably from 8 mm to 10 mm. The conductive layer is formed of a material such as a conductive elastic body or the like. As the conductive elastic body, a material conventionally used in this field is applicable including, for example, ethylene-propylene-diene rubber (EPDM), foamed EPDM, and urethane foam, which contain a conductive material such as carbon black. Through the conductive layer, high voltage is evenly applied to the intermediate transfer belt 21.

In order to transfer the toner images formed on the surfaces of the photoreceptor drum 11*y*, 11*m*, 11*c*, and 11*b* onto the intermediate transfer belt 21, intermediate transfer bias is applied to the intermediate transfer rollers 22*y*, 22*m*, 22*c*, and 22*b* by a constant voltage control, which bias has a reverse polarity from the charged toner. By so doing, the toner images of yellow, magenta, cyan, and black formed on the photoreceptor drums 11*y*, 11*m*, 11*c*, and 11*b* are sequentially transferred and overlaid on top of one another on the toner image bearing surface 21*a* of the intermediate transfer belt 21, thus forming a multicolor toner image. Note that in the case where image information of only a part of yellow, magenta, cyan, and black is inputted, a toner image is formed by only an image forming unit corresponding to a color of an image information to be input, among the image forming units 10*y*, 10*m*, 10*c*, and 10*b*.

The supporting rollers 23, 24, and 25 are rotatably disposed about respective shaft centers thereof by a driving section (not shown). The intermediate transfer belt 21 is supported around the supporting rollers 23, 24, and 25 with tension and rotated in the direction of the arrow 27. For each of the supporting rollers 23, 24, and 25, an aluminum cylinder (a pipe-shaped roller) is used, for example, having a diameter of 30 mm and a thickness of 1 mm. The supporting roller 24 comes into pressure-contact with a later-described secondary transfer roller 28 with the intermediate transfer belt 21 interposed therebetween, thus forming a secondary transfer nip portion, and is electrically grounded. The supporting roller 24 has a function of supporting the intermediate transfer belt 21 therearound with tension together with a function of secondarily transferring the toner image on the intermediate transfer belt 21 onto the recording material 8.

The belt cleaner 26 is a member that removes a toner remaining on the toner image bearing surface 21*a* after transferring a toner on the toner image bearing surface 21*a* of the intermediate transfer belt 21 onto the recording material 8, and is disposed opposite to the supporting roller 25 with the intermediate transfer belt 21 interposed therebetween. The belt cleaner 26 includes a cleaning blade 26*a* and a toner storing container 26*b*. The cleaning blade 26*a* is a platy member which comes into pressure-contact with the toner image bearing surface 21*a* of the intermediate transfer belt 21 by a pressure section (not shown) and scrapes off the residual toner or the like on the toner image bearing surface 21*a*. As the cleaning blade 26*a*, it is possible to use a blade made of a rubber material (e.g. urethane rubber) having elasticity, for example. The toner storing container 26*b* serves to temporarily store the toner and the like that are scraped off by the cleaning blade 26*a*.

In the intermediate transfer section 3, the toner images formed on the photoreceptor drums 11*y*, 11*m*, 11*c*, and 11*b* are transferred and thus overlaid on top of one another at predetermined positions on the toner image bearing surface 21*a* of the intermediate transfer belt 21, thus forming a toner image. This toner image is secondarily transferred onto the recording material 8 in the secondary transfer nip portion as described later. The toner, offset toner, paper dust, and the like which remain on the toner image bearing surface 21*a* of the intermediate transfer belt 21 after the secondarily-transferring operation, are removed by the belt cleaner 26. And onto the toner image bearing surface 21*a*, a toner image is transferred again.

The secondary transfer section 4 includes the supporting roller 24 and the secondary transfer roller 28. The secondary transfer roller 28 is a roller-shaped member that is brought into pressure-contact with the supporting roller 24 through the intermediate transfer belt 21, is provided to be driven rotatably around an axis direction, and is rotationally driven by the driving section (not shown). For example, the secondary transfer roller 28 is comprised of a metal shaft body and a conductive layer covering the surface of the metal shaft body. The metal shaft body is made of a metal such as stainless steel, for example. The conductive layer is made of a conductive elastic element or the like. As the conductive elastic element, those commonly used in this field are usable, and examples thereof include EPDM, foamed EPDM, and foamed urethane that contain a conductive agent such as carbon black. The secondary transfer roller 28 is connected to a not-shown power source, to which a high voltage having a polarity opposite to the charging polarity of toner is uniformly applied. A pressure-contact portion among the supporting roller 24, the intermediate transfer belt 21, and the secondary transfer roller 28 is a secondary transfer nip portion.

In the secondary transfer section 4, the toner image on the intermediate transfer belt 21 is transported to the secondary transfer nip portion, and in synchronization therewith, the recording material 8 that is fed from the recording material feeding section 5 described below is transported to the secondary transfer nip portion, and the toner image and the recording material 8 are overlaid at the secondary transfer nip portion so that the toner image is secondarily transferred to the recording material 8. In this manner, an unfixed toner image is borne on the recording material 8. The recording material 8 that bears the unfixed toner image is transported to the fixing device 6.

The fixing device 6 heats and fuses the toner constituting the unfixed toner image borne on the recording material 8 to fix it on the recording material 8. A detailed configuration of the fixing device 6 will be described below. The recording material 8 to which the toner image has been fixed is discharged to a discharge tray 110, and image formation is completed.

The recording material feeding section 5 includes a recording material cassette 42, a pickup roller 43, and registration rollers 44*a* and 44*b*. The recording material cassette 42 stores the recording material 8. Specific examples of the recording material 8 include plain paper, coated paper, paper only for color copy, a film for OHP (overhead projector), and a post card. Size of the recording material 8 includes A4, A3, B5, B4, a postcard size and the like. The pickup roller 43 feeds the recording material 8 sheet by sheet to a conveyance path P. The registration rollers 44*a* and 44*b* are a pair of roller members which are disposed in pressure-contact with each other, and serve to feed the recording material 8 to the secondary transfer nip portion in synchronization with conveyance of the multicolor toner image on the intermediate transfer belt 21 to the secondary transfer nip portion.

In the recording material feeding section 5, the recording material 8 stored inside the recording material cassette 42 is fed sheet by sheet to the conveyance path P by the pickup roller 43, and furthermore fed to the secondary transfer nip portion by the registration rollers 44*a* and 44*b*.

The scanner section 7 includes a scanner platen, a light source, and a CCD (charge coupled device) image sensor 9.

On an upper face of the scanner platen, a to-be-copied document is placed. A plate-shaped member made of a light transmitting material such as transparent glass is used for the scanner platen. The light source illuminates the document placed on the scanner platen. The CCD image sensor 9 photoelectrically converts light reflected from the document illuminated by the light source, thereby converting the reflected light to image data (image signals). The CCD image sensor 9 includes a converting section, a transfer section and an output section. The converting section converts light signals of the reflection light to electric signals. The transfer section sequentially transfers the electric signals to the output section in synchronism with clock pulses. The output section converts the electric signals to voltage signals, amplifies the voltage signals, makes the signals low-impedance, and outputs the signals. The analog signals obtained in this manner are converted into digital signals by well-known image processing. The image data of the document read by the scanner section 7 is sent to a CPU (central processing unit) for controlling all operations of the image forming apparatus, where the image data is subjected to the various image processes. And thereafter, the image data is temporarily stored in a memory. In response to an output command, the image stored in the memory is read out and transferred to the light scanning unit 13, whereby the image is formed on a recording sheet of the recording material 8.

The toner used in the invention contains a binder resin, a colorant, and a release agent. As the binder resin, ingredients customarily used in this field can be used, and examples thereof include polystyrene, a homopolymer of styrene substitute, a styrene-type copolymer, polyvinyl chloride, polyvinyl acetate, polyethylene, polypropylene, polyester, and polyurethane.

The binder resins may be used each alone, or two or more thereof may be used in combination. Among the above binder resins, for the color toner, preferable is the binder resin which has a softening temperature of 100° C. to 150° C. and a glass transition temperature of 50° C. to 80° C., and particularly preferable is polyester which has a softening temperature and a glass transition temperature in the above ranges, from the aspects of storage stability, durability and the like. Polyester in a softened or fused state is high in transparency.

In the case where polyester is used as the binder resin, when a multicolor toner image composed of combined toner images of yellow, magenta, cyan, and black, is fixed on a recording material 8, the polyester itself becomes transparent, leading to sufficient color development by subtractive color mixture.

As the colorant, it is possible to use pigments and dyes for toner which have been conventionally used in the electrophotographic image forming technique.

Examples of the pigments include organic pigments such as azo pigment, benzimidazolone pigment, quinacridone pigment, phthalocyanine pigment, isoindolinone pigment, isoindoline pigment, dioxazine pigment, anthraquinone pigment, perylene pigment, perynone pigment, thioindigo pigment, quinophthalone pigment, and metal complex pigment; inorganic pigments such as carbon black, titanium oxide, molybdenum red, chrome yellow, titanium yellow, chrome oxide, or Berlin blue; and metal powders such as aluminum powder. The pigments may be used each alone, or two or more thereof may be used in combination.

As the release agent, wax can be used, for example. It is possible to use the wax which is customarily used in this field such as polyethylene wax, polypropylene wax, and paraffin wax.

The toner may contain, other than the binder resin, colorant, and release agent, one or two or more additives for general use in toner, such as a charge control agent, a fluidity improving agent, a fixing promoting agent, and a conductive agent.

The toner can be manufactured according to the heretofore known methods such as a pulverization method, a suspension polymerization method, and an emulsification coagulation method. In the pulverizing method, the colorant, the release agent, etc. are melt-kneaded together with the binder resin, followed by pulverization. In the suspension polymerization method, the colorant, the release agent, a monomer of the binder resin, etc. are evenly dispersed, followed by polymerization of the monomer of the binder resin. In the emulsification coagulation method, binder resin particles, the colorant, the release agent, etc., are coagulated with the aid of a coagulant, and fine particles of a thus-obtained coagulated product are heated.

A volume average particle size of the toner is not particularly limited, and a preferable diameter thereof falls in a range of from 2 μm to 7 μm. When the volume average particle size of the toner is less than 2 μm, the toner may be degraded in fluidity, leading to insufficient supply, stirring, and charging of the toner upon the developing operation. This may cause a shortage of the toner amount, an increase of toner of reverse polarity, and the like problem, which possibly leads to a failure in forming high-quality images. When the volume average particle size of the toner exceeds 7 μm, a larger amount of the toner particles has such a large diameter that a center part of each toner particle is hard to be soften, with the result that a fixing property of the image onto the recording material 8 is degraded and moreover, the color development of the image is lower. And particularly in the case of fixing the image onto an OHP sheet, an obtained image becomes darker.

In the embodiment, the toner except the pigment has the same configuration as follows. The toner used in the embodiment is a negatively-charged nonmagnetic insulating toner which has, for example, a glass transition temperature of 60° C., a softening temperature of 120° C., and a volume average particle size of 6 μm.

When using the toner to obtain an image having an image density of 1.4 measured by a 310 reflection densitometer manufactured by X-Rite incorporated, a required toner amount is 5 g/m$^2$.

The toner contains polyester (the binder resin) having a glass transition temperature of 60° C. and a softening temperature of 120° C., a low-molecular polyethylene wax (the release agent) having a glass transition temperature of 50° C. and a softening temperature of 70° C., and pigments of respective colors. A content of the wax is 7% by weight of the total amount of the toner while a content of the pigment is 12% by weight of the total amount of the toner, with the binder resin, i.e., polyester which occupies a remaining part of the total amount of the toner. The low-molecular polyethylene wax contained in the toner is wax whose glass transition temperature and softening temperature are lower than those of the polyester serving as the binder resin.

Figure 3:
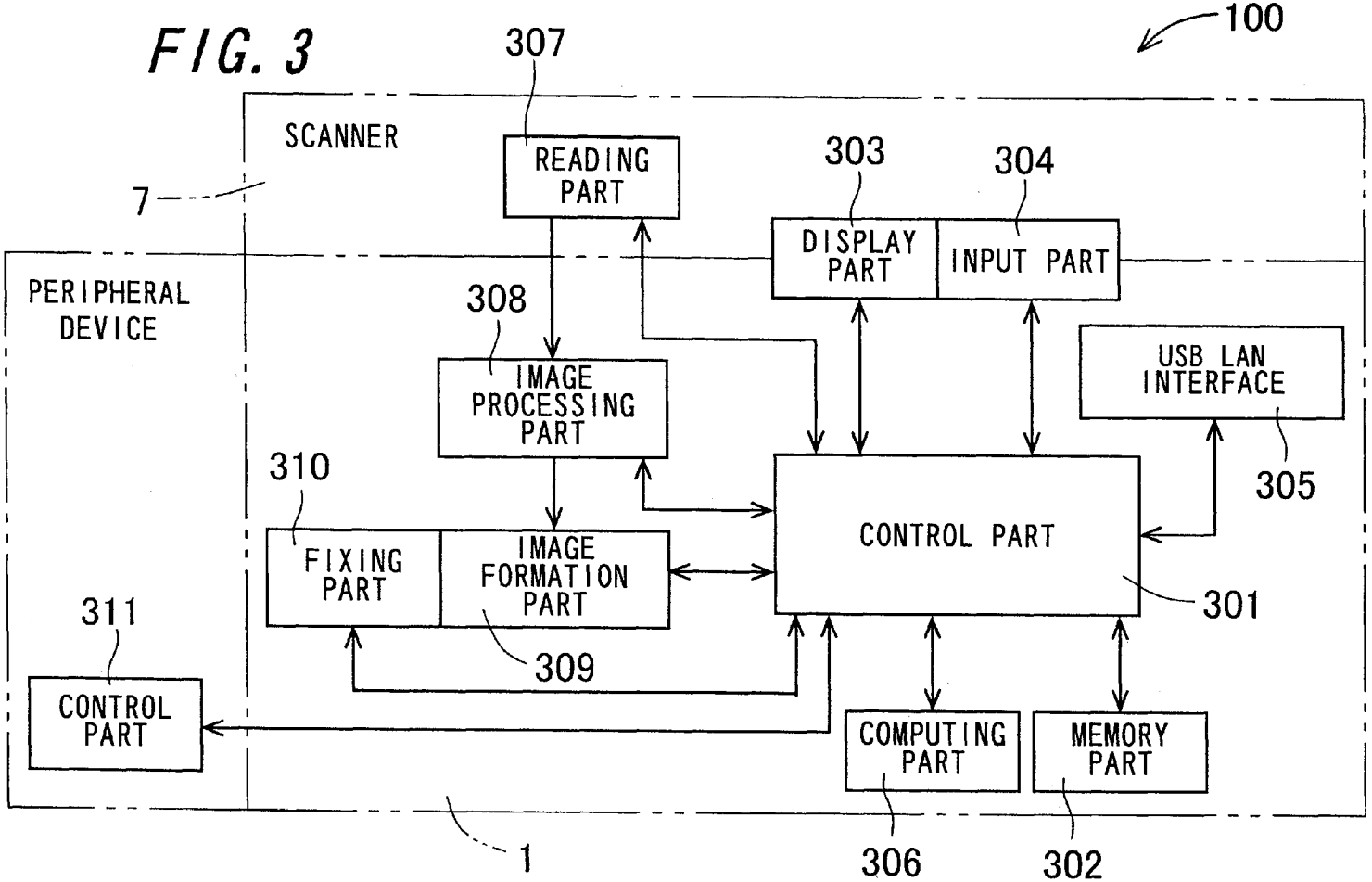
FIG. 3 is a block diagram showing the electrical configuration of a copier.

FIG. 3 is a block diagram showing the electrical configuration of a copier 100.

The copier 100 includes a control part 301, and the control part 301 controls the whole operation of the copier 100 on the basis of various control programs stored in a memory part 302. The control part 301 carries out operation control based on print instruction entered through an operation panel (including a display part 303 and an input part 304) arranged on an upper surface of the copier 100, detection results from various sensors arranged in the copier 100, image data entered from external devices through USB/LAN interface 305, various set values for controlling operations of each device in the copier 100, and data table.

The memory part 302 can use memories conventionally used in this field, and examples thereof include read only memory (ROM), random access memory (RAM) and hard disk drive (HDD).

External devices connected to the copier 100 can use electric and electrical devices capable of forming or acquiring image data and capable of electrically connecting to the copier 100, and examples thereof include personal computers and digital cameras.

The computing part 306 takes out the various data (the print command, the detected results, the image information, and the like) stored in the memory part 302, and the program for performing the various controls. On the basis of the above various data and programs, the computing part 306 makes various detections or determinations. According to various results of determinations, operations and the like obtained by the computing part 306, the control part 301 sends a control signal to relevant units and control operations thereof.

The control part 301 and the computing part 306 are, for example, processing circuits which are realized by a microcomputer, a microprocessor or the like which has a CPU.

The scanner part 7 includes a reading part 307 which reads original image, and the original image read with the reading part 307 is converted into appropriate electrical signals by the image processing part 308, and image data are formed. The image formation part 309 prepares an electrostatic latent image on the basis of the image data prepared. The image is developed using a toner, and an unfixed toner image is formed on a recording paper. The fixing part 310 fixes the unfixed toner image formed by the image formation part 309 to a transfer paper under application of heat.

Further, peripheral devices such as a finisher and a sorter, as a post-processing device, are operationally controlled by a peripheral device control part 311.

Although not shown, a main power source supplies electric power to each operation part of the copier 100.

Figure 4:
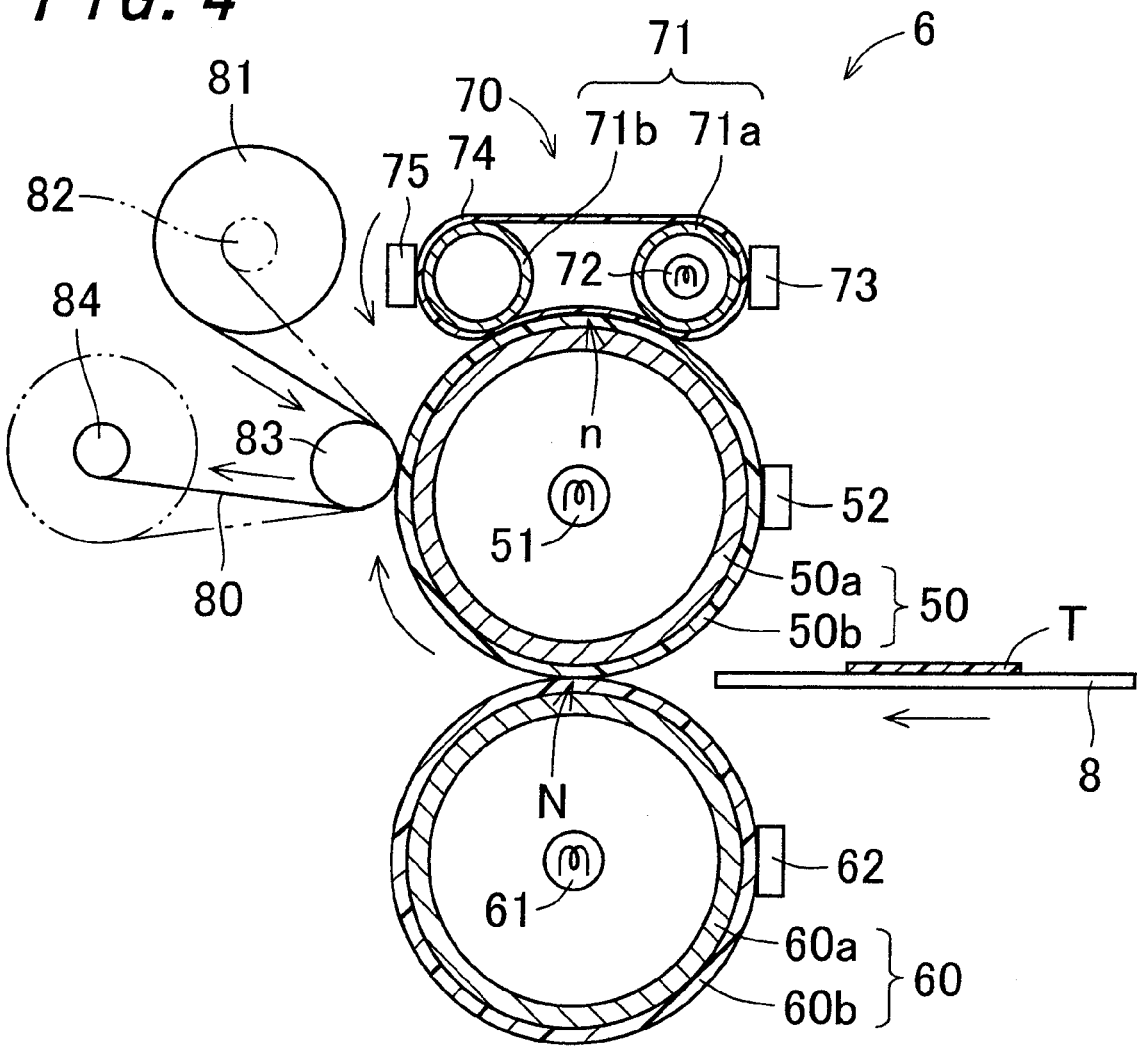
FIG. 4 is a cross-sectional view schematically showing the constitution of the fixing device according to the embodiment of the invention.

FIG. 4 is a cross-sectional view schematically showing the constitution of the fixing device 6 which is the embodiment of the invention. The constitution of the fixing device 6 is described in detail below using FIG. 4.

The fixing device 6 comprises a fixing roller 50, a pressure roller 60, an external heating section 70 and a cleaning section 80, as shown in FIG. 4.

The fixing roller 50 and the pressure roller 60 are in pressure-contact with each other by a predetermined load (for example, 600N), and a portion at which the surface of the fixing roller 50 and the surface of the pressure roller 60 are in contact with each other (hereinafter referred to as "fixing nip portion N") is formed therebetween.

In the present embodiment, a nip width (length along a rotating direction of the fixing roller 50 and the pressure roller 60) of the fixing nip portion N is set to, for example, 9 mm.

The fixing roller 50 is heated to a fixing temperature (for example, 180° C.), and heats the recording material 8 on which an unfixed toner image passing the fixing nip portion N is formed. The fixing roller 50 is a roller member having a three-layer structure comprising a metal core 50*a*, an elastic layer 50*b* formed on the outer periphery thereof, and a release layer formed on the outer periphery of the elastic layer 50*b*. The metal core 50*a* uses metals such as iron, stainless steel, aluminum and copper, or alloys thereof.

Further, the elastic layer 50*b* uses a silicone rubber, and the release layer uses fluorine resins such as PFA (copolymer of tetrafluoroethylene and perfluoroalkyl vinyl ether) and PTFE (polytetrafluoroethylene).

A heater lamp (halogen lamp) 51 as a heat source for heating the fixing roller 50 from the inside thereof is arranged in the metal core 50*a* of the fixing roller 50.

Current application to the heater lamp 51 is controlled by a control part 301, and when turned on, the heater lamp 51 emits infrared ray to the inner periphery of the metal core 50*a*. The infrared ray emitted is absorbed in the inner periphery of the metal core 50*a*, heats the metal core 50*a*, and is thermally transmitted to the elastic layer 50*b* and then the release layer. As a result, the whole fixing roller 50 is heated.

The pressure roller 60 comes into pressure-contact with the fixing roller 50 by a pressure-contact mechanism provided on the opposite side of the fixing nip portion N across a rotation axis thereof, and applies predetermined pressure to the fixing nip portion N. As well as the fixing roller 50, the pressure roller 60 is a roller member having a three-layer structure comprising a metal core 60*a* comprising metals such as iron, stainless steel, aluminum and copper, or alloys thereof, an elastic layer 60*b* of silicone rubber or the like formed on the surface of the metal core 60*a*, and further an release layer of PFT, PTFE or the like formed on the surface of the elastic layer 60*b*.

Further, in the present embodiment, a heater lamp 61 is provided in the metal core 60*a* even in the pressure roller 60. Current application to the heater lamp 61 is controlled by the control part 301, and when turned on, the heater lamp 61 emits infrared ray to the inner periphery of the metal core 60*a*. The infrared ray emitted is absorbed in the inner periphery of the metal core 60*a*, heats the metal core 60*a*, and is thermally transmitted to the elastic layer 60*b* and the release layer. As a result, the whole pressure roller 60 is heated.

The external heating section 70 comprises an endless external heating belt 74, and a pair of rotation supporting rollers 71 around which the external heating belt 74 is supported. The details are described hereinafter by reference to FIG. 5. The external heating section 70 is provided with a separation/contact mechanism which carries out separation/contact operation of the rotation supporting roller 71 with respect to the surface of the fixing roller 50.

The external heating belt 74 comes into contact with the surface of the fixing roller 50 in a state where the external heating belt 74 is heated to a temperature (for example, 210° C.) higher than the fixing temperature, and heats the surface of the fixing roller 50. Heat is supplied to the external heating belt 74 from the rotation supporting roller 71 contacting the inner periphery of the belt. The external heating belt 74 is arranged such that the belt comes into pressure-contact with the surface of the fixing roller 50 on the opposite side of the fixing nip portion N across a rotation axis of the fixing roller 50, and comes into pressure-contact with the fixing roller 50 under application of predetermined force (for example, 40N) by a separation/contact mechanism described hereinafter. This pressure-contact forms a portion (hereinafter referred to as "heating nip portion n") at which the surface of the external heating belt 74 and the surface of the fixing roller 50 come into contact with each other. In the present embodiment, a nip width (length along a rotation direction of the fixing roller 50) of the heating nip portion n is, for example, 20 mm.

The external heating belt 74 is an endless belt member having a two-layer structure composed of a hollow cylindrical substrate made of a heat-resistant resin such as polyimide, or a metal material such as stainless steel or nickel, and a synthetic resin material (for example, fluorine resin such as PFA or PTFE) having excellent heat resistance and releasability formed as a release layer on the surface of the substrate.

The external heating belt 74 rotates so as to follow the rotation of the fixing roller 50, and preferably has a coating layer such as a fluorine resin provided on the inner periphery thereof in order to reduce approaching force.

The rotation supporting roller 71 comprises a hollow cylindrical metal core material made of aluminum or an iron-based material, and is composed of a pair of roller members of a rotation supporting roller 71*a* and a rotation supporting roller 71*b*. A coating layer such as a fluorine resin may be applied to the surface of the metal core material in order to reduce approach force of the external heating belt 74. A heater lamp 72 as a heat source is provided in the inside of the rotation supporting roller 71. The heater lamp 72 is provided in only one roller of a pair of rollers. In the present embodiment, the heater lamp 72 is provided in the inside of the rotation supporting roller 71*a*.

Current application to the heater lamp 72 is controlled by the control part 301, and when turned on, the heater lamp 72 emits infrared ray to the inner periphery of the metal core material. The infrared ray emitted is absorbed in the inner periphery of the metal core material, and the whole rotation supporting roller 71*a* is heated. The heated rotation supporting roller 71*a* heats the external heating belt 74 from the inner periphery thereof.

A thermistor (temperature detection section) 52 for detecting a surface temperature of the fixing roller 50 is arranged on the outer periphery of the fixing roller 50, and a thermistor 62 for detecting a surface temperature of the pressure roller 60 is arranged on the outer periphery of the pressure roller 60.

Further, in the outer periphery of the external heating belt 74, thermistors 73 and 75 are arranged at positions facing the rotation supporting roller 71*a* and the rotation supporting roller 71*b*, respectively.

The control part 301 detects surface temperatures at predetermined positions of the fixing roller 50, the pressure roller 60 and the external heating belt 74 based on output of these thermistors 52, 62, 73 and 75, and controls current application to the corresponding heater lamps 51, 61 and 72 such that each surface temperature approaches the target temperature.

A cleaning section 80 comprises a cleaning web 81, a feed-out roller 82, a web pressing roller 83, and a take-up roller 84, and removes offset toner and the like adhered to the surface of the fixing roller 50.

The cleaning web (hereinafter simply referred to as "web") 81 is provided so as to be fed to the web pressing roller 83 from the feed-out roller 82, wound on the web pressing roller 83, brought into pressure-contact with the surface of the fixing roller 50, and then wound up by the take-up roller 84.

The web 81 can use, for example, heat-resistant nonwoven fabric. The heat-resistant nonwoven fabric is not particularly limited, and includes nonwoven fabric containing aromatic polyamide fiber and polyester fiber which softens at high temperature, having appropriate flexibility and mechanical strength in combination. The heat-resistant nonwoven fabric is commercially available, and examples thereof include NOMEX (trade mark) and HIMELON (trade name).

The web 81 can be impregnated with an oil having a release effect. The oil can use oils generally used in this field, and examples thereof include silicone oils such as dimethyl silicone oil, amino-modified silicone oil, mercapto-modified silicone oil and fluorine-modified silicone oil.

The thickness of the web 81 is not particularly limited, and is preferably 30 μm to 100 μm. In the present embodiment, a web having a thickness of 40 μm is used as the web 81.

The feed-out roller 82 is supported so as to be drivenly rotatable around the axis thereof, and the web 81 is taken up and held on the surface thereof. In the present embodiment, the feed-out roller 82 is constituted such that the feed-out roller 82 drivenly rotates in a counterclockwise direction to a take-up operation of the web 81 by the take-up roller 84, thereby feeding the web 81.

The web pressure-contact roller 83 is a roller-shaped member in which both ends in a longitudinal direction are supported by bearings (not shown) so as to be drivenly rotatable. The web pressing roller 83 is provided so as to come into pressure-contact with the surface of the fixing roller 50 with the web 81 interposed therebetween by a pressing section (not shown). The web pressing roller 83 drivenly rotates at the time of take-up operation of the web 81 by the take-up roller 84.

The web pressing roller 83 uses, for example, a roller-shaped member comprising a metal core and an elastic layer formed on the surface of the metal core. Examples of an elastic material constituting the elastic layer include a heat-resistant rubber such as silicone rubber, and foam thereof. Surface hardness of the elastic layer is not particularly limited, but is preferably 20° to 30° (Asker-c, Asker C hardness).

The take-up roller 84 is supported so as to be rotatable around the axis thereof by a drive section (not shown), and takes up the web 81 after contacting the fixing roller 50. In the present embodiment, the take-up roller 84 is provided so as to separate from the feed-out roller 82 and the external heating section 70 in the upper side of a nearly vertical direction of the web pressing roller 83. The web 81 is fed from the feed-out roller 82 by the rotation of the take-up roller 84, and cleaning operation is initiated.

Operation of the cleaning section 80 is controlled by the control part 301. The control part 301 detects the fact that predetermined sheets of recording material 8 pass through the fixing nip portion N, by a sensor or the number of rotation of the fixing roller 50, and then send a control signal to a drive section which rotates the take-up roller 84. The drive section having received the control signal rotates the take-up roller 84 and winds up a constant amount of the web 81.

The present embodiment has the constitution that control of current application to heater lamps 51, 61 and 72 is carried out by the control part 301 of the copier 100, but a constitution may be employed such that the fixing device 6 itself is provided with an independent control part.

Further, driving force is transmitted to one end in an axial direction of a rotation shaft of the fixing roller 50 from a drive motor (driving source), and the fixing roller 50 is rotationally driven.

At the time of fixing operations, by that the fixing roller 50 is rotationally driven, the pressure roller 60 brought into pressure-contact with the fixing roller 50 is drivenly rotated by frictional force generated in the fixing nip portion N. As a result, the rotation direction of the pressure roller 60 is a reverse direction to the rotation direction of the fixing roller 50.

The external heating belt 74 of the external heating section 70 is rotated by following the rotation of the fixing roller 50 by frictional force generated in the heating nip portion n which is brought into contact with the fixing roller 50.

Therefore, the rotation direction of the external heating belt 74 is a reverse direction to the rotation direction of the fixing roller 50. The surface of the rotation supporting roller 71 comes into contact with the inner periphery of the external heating belt 74, thereby the rotation supporting roller 71 is rotated by following the rotation of the external heating belt 74.

The recording material 8 is fed to the fixing nip portion N such that the formation surface of an unfixed toner image comes into contact with the fixing roller 50 and the opposite surface comes into contact with the pressure roller 60. By that the recording material 8 passes through the fixing nip portion N, the unfixed toner image formed on the recording material 8 is pressurized against the surface of the recording material 8 under application of heat and fixed thereto. The fixing speed which is a passing speed of the conveyance path P in the fixing nip portion N is the same as a process speed (paper conveying speed). In the present embodiment, for example, the fixing speed is 355 mm/sec. A copying speed represented by the number of continuous supply papers per minute is, for example, 70 sheets/min in the present embodiment.

Now, a separation/contact mechanism 90 which carries out separation/contact operation of the rotation supporting roller 71 with respect to the fixing roller 50 is described below.

Figure 5A:
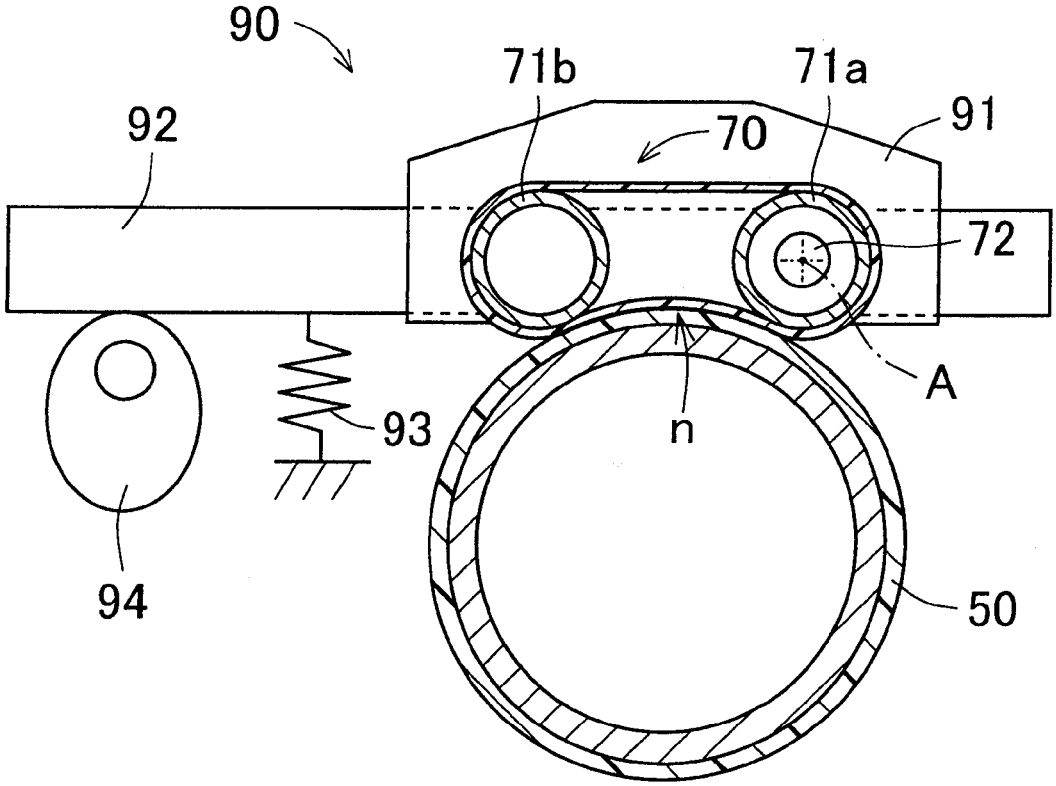
FIGS. 5A and 5B are views showing the constitution of the separation/contact mechanism.
Figure 5B:
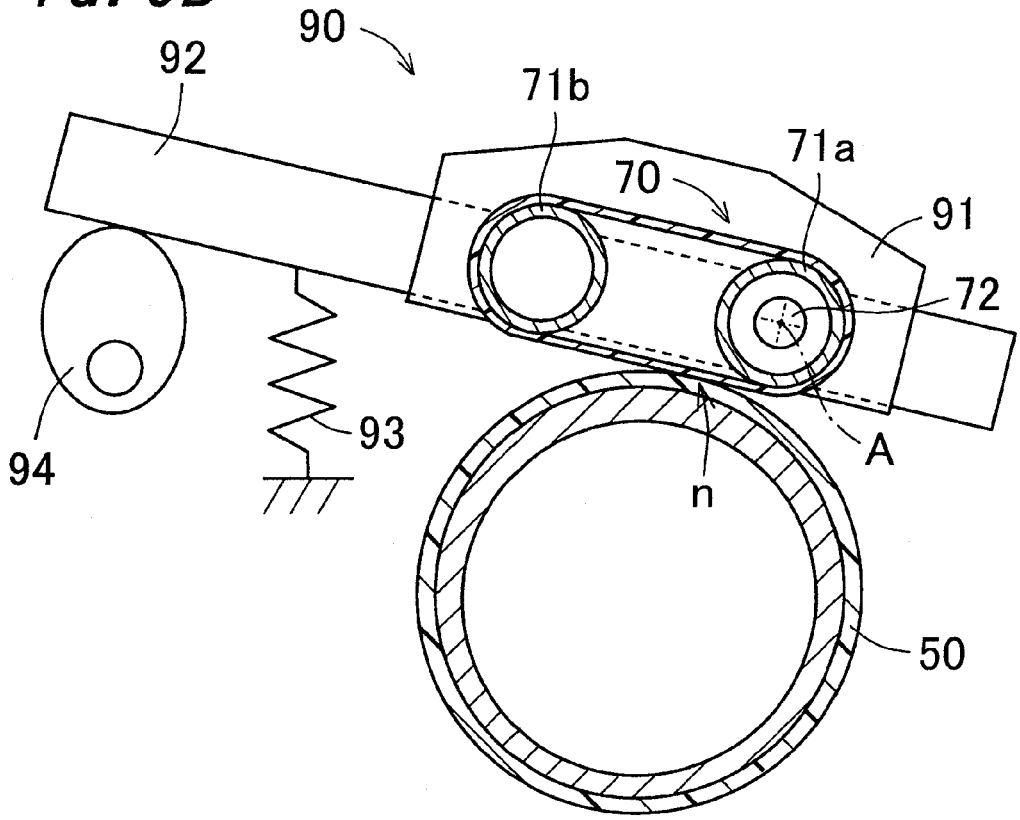

FIGS. 5A and 5B are views showing the constitution of the separation/contact mechanism 90. FIG. 5A shows the state where the rotation supporting roller 71*b* is brought into contact with the fixing roller 50, and FIG. 5B shows the state where the rotation supporting roller 71*b* is separated from the fixing roller 50.

The rotation supporting roller 71*a* having the heater lamp 72 therein and the rotation supporting roller 71*b* which does not have a heater lamp therein are rotatably supported to a plate-like side frame 91 through bearings at both ends of the respective rotation shafts.

The bearings are fixed to the side frame 91 with a predetermined shaft-to-shaft distance, and the degree of parallelization is kept between the rotation supporting rollers 71*a* and 71*b*. The side frame 91 is fixed to an arm 92, and a turn axis A of the arm 92 is the same as the rotation axis of the rotation supporting roller 71*a*. The arm 92 is rotatably attached to a main frame of the image forming apparatus 1.

One end of a coil spring 93, other end thereof being fixed to a main frame, is attached to the arm 92, and the arm 92 and the side frame 91 supported by the arm 92 are biased to the fixing roller 50 side using the turn axis A as a supporting point by a pull force of the coil spring 93.

In the state where the rotation supporting rollers 71*a* and 71*b* are brought into pressure-contact with the fixing roller 50 with the external heating belt 74 interposed therebetween as shown in FIG. 5A, the rotation supporting rollers 71*a* and 71*b* are constituted so as to be in pressure-contact with the fixing roller 50 under equal load.

An eccentric cam 94 is provided so as to turn the arm 92 using the turn axis A as a supporting point. The eccentric cam 94 is arranged such that a coil spring 93 is located between the turn axis A and the eccentric cam 94.

In the state where the rotation supporting rollers 71*a* and 71*b* are brought into pressure-contact with the fixing roller 50 with the external heating belt 74 interposed therebetween, the side (short axis side) that the rotation axis of the eccentric cam 95 is nearest to the peripheral face of the cam comes into contact with the arm 92. When the eccentric cam 94 is rotated 180°, the side (long axis side) that the rotation axis of the eccentric cam 94 is farthest from the peripheral face of the cam comes into contact with the arm 92. In this case, as shown in FIG. 5B, the arm 92 turns using the turn axis A as a supporting point against spring force of the coil spring 93, and the rotation supporting roller 71*b* is separated from the fixing roller 50.

The turn axis A is immobile. Therefore, even in the case where the rotation supporting roller 71*b* is separated from the fixing roller 50, the rotation supporting roller 71*a* does not change its position to the fixing roller 50, and the state where the rotation supporting roller 71*a* comes into pressure-contact with the fixing roller 50 with the external heating belt 74 interposed therebetween is maintained.

The constitution of the separation/contact mechanism 90 has a simple structure as compared with the mechanism that both the rotation supporting rollers 71*a* and 71*b* are separated from and brought into contact with the fixing roller 50, and therefore leads to reduction in size of an apparatus.

For the purpose of rapidly increasing and decreasing temperature on the surface of the fixing roller 50, a pressure-contact state where both the rotation supporting rollers 71*a* and 71*b* come into pressure-contact with the fixing roller 50 as shown in FIG. 5A and a separated state where the rotation supporting roller 71*a* comes into pressure-contact with the fixing roller 50 and the rotation supporting roller 71*b* is separated from the fixing roller as shown in FIG. 5B, are appropriately switched.

When switching from the separated state to the pressure-contact state, impact force is transmitted to the rotation supporting roller 71 through the external heating belt 74.

However, the turn axis A and the rotation axis of the rotation supporting roller 71*a* having the heater lamp 72 therein are the same. Therefore, large impact force is not transmitted to the rotation supporting roller 71*a*, and impact force mainly is transmitted to the rotation supporting roller 71*b*. A heater lamp is not provided in the rotation supporting roller 71*b*. Therefore, impact force is not almost transmitted to the heater lamp 72 by separation/contact operation, and breakage of the heater lamp 72 can be prevented.

Even in the separated state, the rotation supporting roller 71*a* comes into pressure-contact with the fixing roller 50 under a constant pressure. Therefore, when the fixing roller 50 is rotated, the external heating belt 74 rotates by following the rotation of the fixing roller 50 without fail.

The heating nip portion n varies depending on habit of curve and temperature of the external heating belt 74, but the nip width is set to 20 mm in the pressure-contact state. On the other hand, in the separated state, the fixing roller and the external heating belt are separated such that the nip width is 5 mm in order to prevent temperature unevenness of the fixing roller and prevent local concentration of heat to the external heating belt.

The external heating belt 74 has a constitution that a fluorine resin composed of a blend of PTFE and PFA as a release layer is applied to the surface of, for example, a polyimide (trade name: UPILEX-S, manufactured by Ube Industries, Ltd.) substrate having a thickness of 90 mm in a coating thickness of 20 μm. Peripheral length of the external heating belt 74 is 94.24 mm (under room temperature condition). The external heating belt 74 is bridged over the rotation supporting rollers 71*a* and 71*b* having fixed shaft-to-shaft distance, and comes into pressure-contact with the fixing roller 50 under a load of 40N.

The fixing roller 50 uses a roller comprising an aluminum metal core 50*a*, a silicone rubber layer having a thickness of 3 mm as an elastic layer 50*b* formed on the surface of the metal core 50*a*, and a PFA tube having a thickness of 30 μm as a release layer formed on the surface of the elastic layer 50*b*. The fixing roller 50 has a diameter of 50 mm.

The pressure roller 60 uses a roller comprising an aluminum metal core 60*a*, a silicone rubber layer having a thickness of 2 mm as an elastic layer 60*b* formed on the surface of the metal core 60*a*, and a PFA-tube having a thickness of 30 μm formed on the surface of the elastic layer 60*b*. The pressure roller 60 has a diameter of 50 mm which is the same diameter of the fixing roller 50.

Both the rotation supporting rollers 71*a* and 71*b* are an aluminum metal core having a thickness of 0.75 mm, and have a diameter of 15 mm. The surface of those rollers is coated with a fluorine resin comprising a blend of PTFE and PFA. The rotation supporting rollers 71*a* and 71*b* are arranged such that the shaft-to-shaft distance is 23.0 mm.

Both ends in the axial direction of the fixing roller 50 are unavoidable to have heat capacity larger than that of the central part in the axial direction by a journal part of the metal core 50*a*, and in a surface temperature distribution of the fixing roller 50, temperature unevenness is generated to the axial direction. Therefore, temperature distribution in the axial direction of the fixing roller 50 can be homogenized by supplying heat from the surface side of the fixing roller 50 by the external heating belt 74.

During standing by, the fixing roller 50 stands still. Therefore, there is a possibility that only the heating nip portion is excessively heated. However, this can be avoided by carrying out temperature regulation such that the surface temperature of the external heating belt 74 equals to that of fixing roller 50. This temperature regulation does not generate temperature unevenness to a peripheral direction of the fixing roller 50.

Operation control of the separation/contact mechanism is described below.

When the surface temperature of the fixing roller 50 is desired to rapidly increase, that is, just after turning on the power to the copier 100 or when returning from a sleep mode which is the state where current is applied to only the control part 301, the external heating section 70 makes the pressure-contact state in order to efficiently supply heat to the fixing roller 50. Furthermore, when the recording material 8 having an unfixed toner image formed thereon passes through the fixing nip portion N, heat is removed from the fixing roller 50, and the surface temperature of fixing roller 50 is decreased. Heat is supplied by the heater lamp 51 in the fixing roller 50, but in high-speed machine, temperature cannot follow the heat supply, resulting in occurrence of poor fixing. For this reason, to efficiently supply heat to the fixing roller 50 from the external heating belt 74, the external heating section 70 keeps in the pressure-contact state, thereby the surface temperature of the fixing roller 50 can be regulated to a fixing temperature.

Even in a standby state where the fixing roller 50, the pressure roller 60 and the external heating belt 74 are heated such that image formation is immediately possible when receiving input of signal to instruct printing, the external heating section 70 is kept in the pressure-contact state.

Figure 6A:
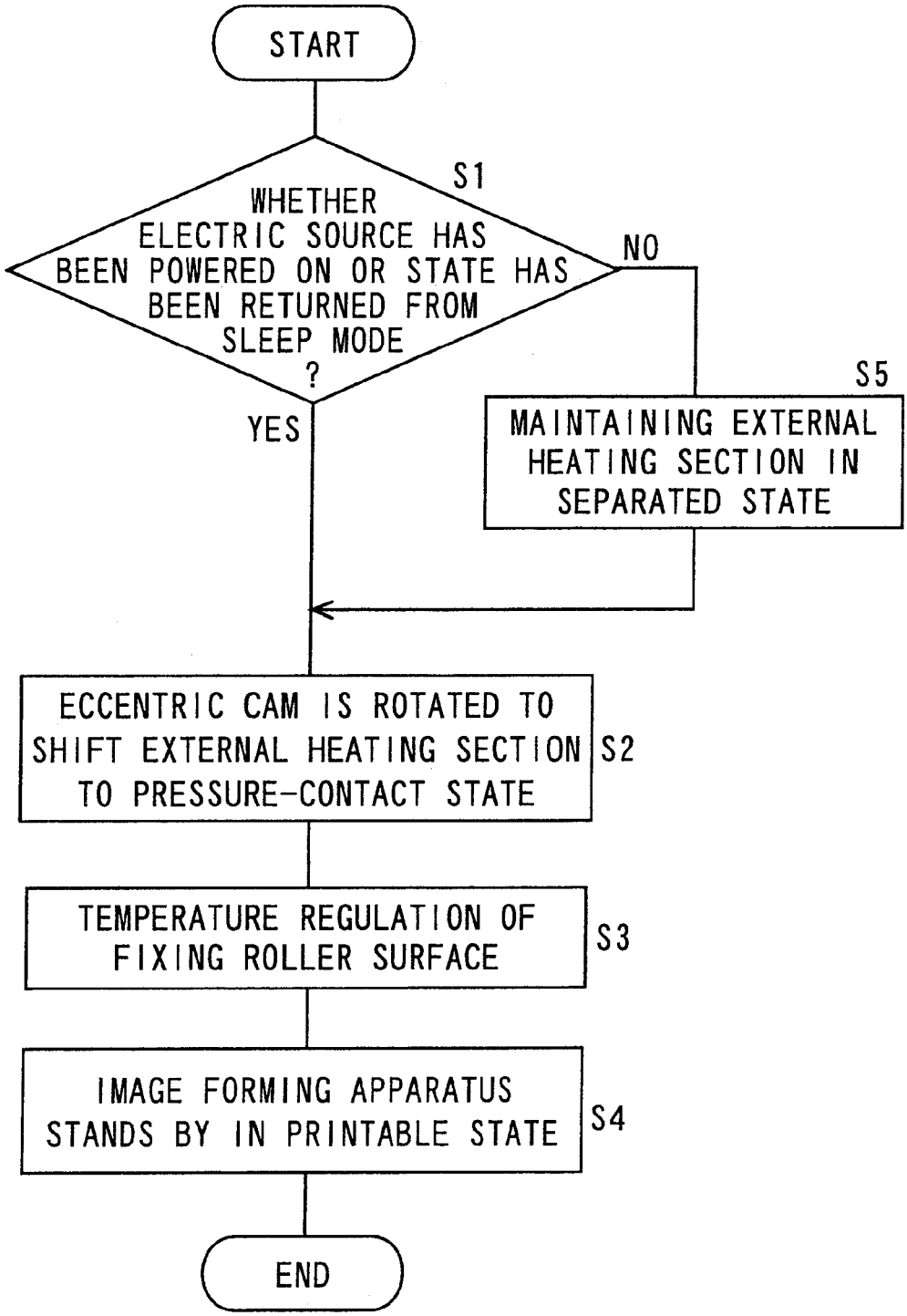
FIGS. 6A and 6B are flow charts showing an operation control processing of the separation/contact mechanism by the control part.
Figure 6B:
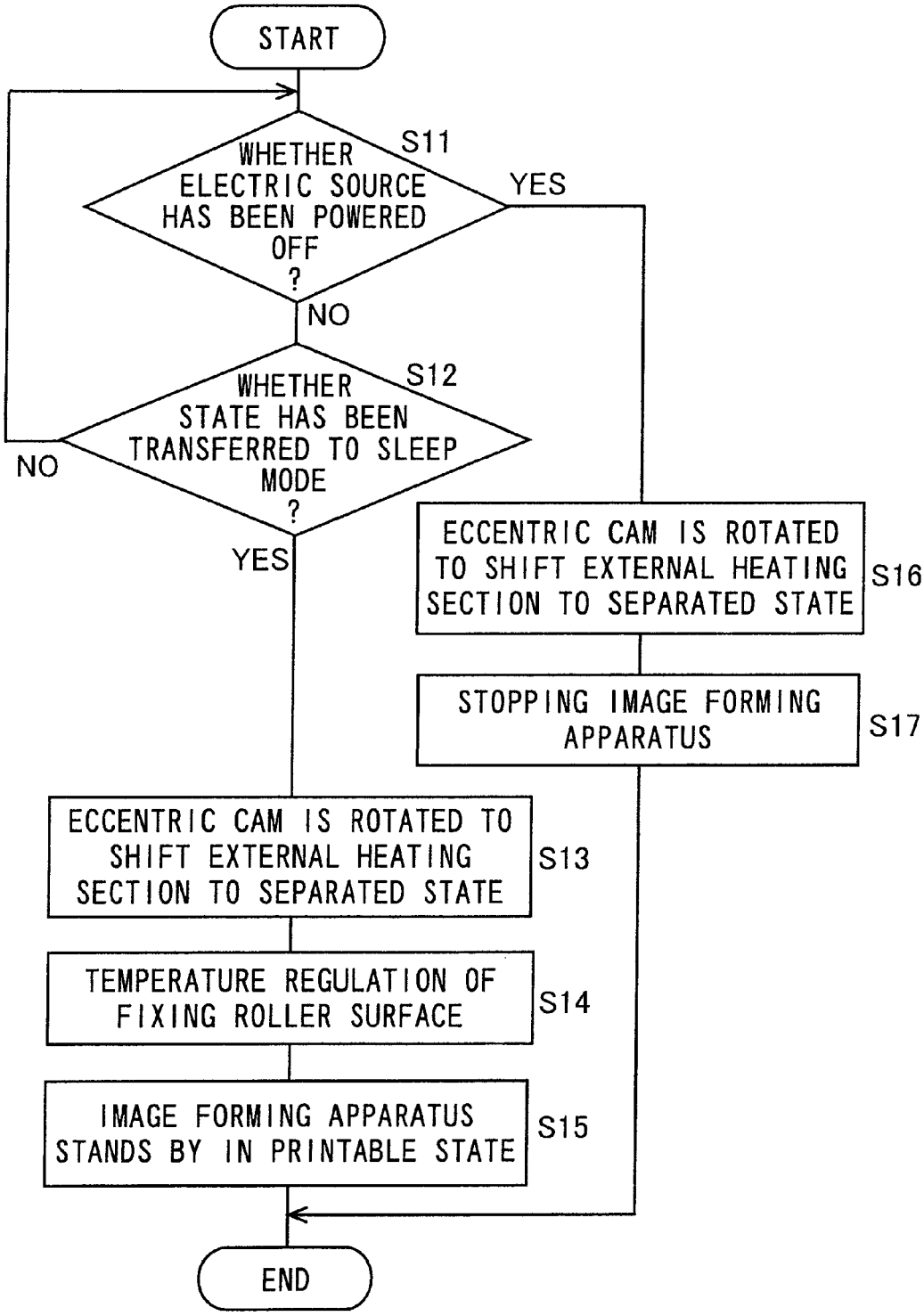

FIGS. 6A and 6B are flow charts showing operation control processing of the separation/contact mechanism 90 by the control part 301. FIG. 6A shows an operation control processing at the time of power-on or when returning from a sleep mode, and FIG. 6B shows an operation control processing at the time of power-off or when shifting to the sleep mode.

First, the flow chart of FIG. 6A is described below. Before turning the power on, that is, in the state of power-off or in the state of the sleep mode, the external heating section 70 is maintained in the separated state.

In step S1, it is judged whether or not the copier 100 or the image forming apparatus 1 is powered on or is returned from a sleep mode. When having been powered on or returned from a sleep mode, the procedure proceeds to step S2. When neither being powered on nor returned, the procedure proceeds to step S5.

In step S2, the eccentric cam 94 is rotated 180° to shift the external heating section 70 from the separated state to the pressure-contact state, and the procedure proceeds to step S3.

In step S3, temperature is regulated so as to increase the surface temperature of the fixing roller 50 to a fixing temperature. The temperature regulation is carried out by detecting the surface temperatures of the fixing roller 50, the pressure roller 60 and the external heating belt 74 based on outputs of thermistors 52, 62, 73 and 75, and controlling current application to the corresponding heater lamps 51, 61 and 72 such that each surface temperature approaches the target temperature. In step S4, the image forming apparatus 1 stands by in a printable state, and waits for input of print instruction.

Thereafter, in the case where print instruction has been entered, the image forming apparatus 1 is operated to perform printing. Where print instruction is not entered, the external heating section 70 is once shifted to the separated state, temperature is regulated so as to eliminate temperature difference between the external heating belt 74 and the fixing roller 50, and the external heating section 70 is again shifted to the pressure-contact state and waits for input of print instruction.

In step S5, the external heating section 70 is maintained in the separated state. In the case of the sleep mode, the surface temperature of the fixing roller 50 is regulated so as to become the printable state by the heater lamp 51 installed inside the fixing roller.

Return from the sleep mode is carried out, for example, when print instruction button of the input part 304 is pressed by a user in the sleep mode state or when print instruction signal is received from an external device.

Next, the flow chart of FIG. 6B is described below. Before power-off, that is, in the state of power-on, the external heating section 70 is maintained in the pressure-contact state, and the surface temperature of the fixing roller 50 is regulated so as to become the printable state.

In step S11, it is judged whether or not the copier 100 or the image forming apparatus 1 has been powered off. When not powered off, the procedure proceeds to step S12, and when powered off, the procedure proceeds to step S16.

In step S12, it is judged whether or not having shifted to the sleep mode. When having been shifted to the sleep mode, the procedure proceeds to step S13. When been not shifted to the sleep mode, the surface temperature of the fixing roller 50 is regulated so as to become the printable state, and the procedure returns to step S11.

In step S13, the eccentric cam 94 is rotated 180° to shift the external heating section 70 to the separated state from the pressure-contact state, and the procedure proceeds to step S14. In step S14, the surface temperature of the fixing roller 50 is regulated so as to become the printable state. The temperature regulation is carried out by detecting the surface temperatures of the fixing roller 50, the pressure roller 60 and the external heating belt 74 based on outputs of thermistors 52, 62, 73 and 75, and controlling current application to the corresponding heater lamps 51, 61 and 72 such that each surface temperature approaches the target temperature. In step S15, the image forming apparatus 1 stands by in the printable state, and waits for input of print instruction.

In step S16, the eccentric cam 94 is rotated 180°, the external heating section 70 is shifted to the separated state from the pressure-contact state, and then the procedure proceeds to step S17. In step S17, power supply to the image forming apparatus 1 is stopped.

In the above description, the embodiment in which the separation/contact mechanism 90 controls separation/contact operation of the external heating section 70 is described on the basis of as to whether the power-on/off state or the sleep mode. Other than this embodiment, there is an embodiment that it is preferred to carry out separation/contact operation control, such as the case where the kind of a recording material to be printed is changed. This embodiment is described below.

As one example, the case where a recoding medium is changed from OHP sheet to a plain paper is described below. In the case where a user operates the input part 304 and inputs print instruction to print on OHP sheet, the control part 301 regulates the surface temperature of the fixing roller 50 to high temperature, for example, 200° C., at which a toner can sufficiently be fixed to OHP sheet. Next, in the case where a user operates the input part 304 and inputs print instruction to print on a plain paper, the above fixing temperature 200° C. to OHP paper is high as a fixing temperature, and high temperature fixing offset of a toner is generated. Therefore, the surface temperature of the fixing roller 50 is regulated to a temperature, for example, 180° C., at which a toner can well be fixed to a plain paper.

In the case of regulating the surface temperature of the fixing roller 50 from high surface temperature to low surface temperature, the eccentric cam 94 is rotated by the control part 301, and the external heating section 70 is shifted to the separated state. This shifting can regulate the surface temperature to a desired fixing temperature in a shorter period of time as compared with temperature regulation in the pressure-contact state.

As another example, the case where rotation of the fixing roller 50 is stopped in the pressure-contact state is described below. When rotation of the fixing roller 50 is stopped, heat transfer to the fixing roller 50 is interrupted. As a result, temperatures of the external heating belt 74 and the rotation supporting rollers 71*a* and 71*b* are increased by temperature gradient in the external heating section 70, the heating nip portion n is locally overheated through the external heating belt 74, and temperature unevenness is generated in a peripheral direction of the fixing roller 50. To prevent temperature unevenness, in the case where rotation of the fixing roller 50 is stopped, the external heating section 70 is shifted from the pressure-contact state to the separated state.

The external heating belt 74 and the rotation supporting rollers 71*a* and 71*b* have small heat capacity. Therefore, where the heating nip portion n is too small, heat concentrates on the external heating belt 74, resulting in promoting deterioration of the external heating belt 74. To overcome those problems, width of the heating nip portion n in the separated state is set to about 5 mm. The width of the heating nip portion n in the separated state is determined by a size of turn angle of the arm 92 having the turn axis A as a supporting point. The turn angle of the arm 92 can appropriately be set by, for example, a size of the eccentric cam 94 or a position contacting the arm 92.

In the case where the external heating belt 74 is in the pressure-contact state while being heated and the temperature of the external belt 74 is then decreased to room temperature or a temperature near room temperature, the external heating belt 74 hardens in a state of pressure-contact with the surface of the fixing roller 50. This may result in poor driven-rotation, and there is a possibility that supply of heat to the fixing roller 50 is insufficient.

Therefore, in transferring to power-off or the sleep mode, when the external heating section 70 obtains the result of temperature detection by the thermistors 73 and 75 in the pressure-contact state and it is detected that the temperature exceeds a predetermined temperature (for example, 130° C.), the eccentric cam 94 is rotated to shift the external heating section 70 to the separated state, and the state is then transferred to power-off or the sleep mode.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A fixing device, comprising:

a fixing member which is rotatably provided around an axis thereof, heats a recording material bearing an unfixed toner image, and melts a toner constituting the unfixed toner image;

a pressure member which is rotatably provided around an axis thereof, comes into pressure-contact with the fixing member to form a pressure-contact portion between the pressure member and the fixing member, pressurizing the conveyed recording material bearing the unfixed toner image at the pressure-contact portion, and fixing the unfixed toner image to the recording material in cooperation with the fixing member;

an external heating section including a plurality of supporting rollers, an endless external heating belt rotatably supported around the plurality of supporting rollers with tension so as to come in contact with an outer periphery of the fixing member, and a heating member for heating the external heating belt, thereby heating the outer periphery; and a separation/contact section which carries out separation/contact operation of the external heating section with respect to the fixing member by rotating the external heating section using a central axis of one supporting roller out of the plurality of supporting rollers, as a rotation axis, wherein out of the plurality of supporting rollers, only the supporting roller having a central axis as the rotation axis has the heating member therein.

2. The fixing device of claim 1, wherein the supporting roller having a central axis becoming the rotation axis comes into pressure-contact with the fixing member with the external heating belt interposed therebetween in both of a separated state where the external heating section is separated from the fixing member and a pressure-contact state where the external heating section comes into pressure-contact with the fixing member.

3. The fixing device of claim 1, wherein the separation/contact section carries out separation/contact operation of the external heating section with respect to the fixing member, based on the surface temperature of the fixing member.

4. An image forming apparatus comprising:

a fixing device, comprising:

a fixing member which is rotatably provided around an axis thereof, heats a recording material bearing an unfixed toner image, and melts a toner constituting the unfixed toner image;

a pressure member which is rotatably provided around an axis thereof, comes into pressure-contact with the fixing member to form a pressure-contact portion between the pressure member and the fixing member, pressurizing the conveyed recording material bearing the unfixed toner image at the pressure-contact portion, and fixing the unfixed toner image to the recording material in cooperation with the fixing member;

an external heating section including a plurality of supporting rollers, an endless external heating belt rotatably supported around the plurality of supporting rollers with tension so as to come in contact with an outer periphery of the fixing member, and a heating member for heating the external heating belt, t hereby heating the outer periphery;

a separation/contact section which carries out separation/contact operation of the external heating section with respect to the fixing member by rotating the external heating section using a central axis of one supporting roller out of the plurality of supporting rollers, as a rotation axis; and a control part which controls operation of the separation/contact section, wherein the control part controls the separation/contact section such that when power source of the image forming apparatus is turned off and when transferring to a sleep mode in which current is applied to only the control part, the external heating section is separated from the fixing member, and when power source of the image forming apparatus is turned on and when returning from the sleep mode, the external heating section comes into pressure-contact with the fixing member.

* * * * *